US006551161B2

(12) United States Patent
Chern et al.

(10) Patent No.: US 6,551,161 B2
(45) Date of Patent: Apr. 22, 2003

(54) LIFE JACKET

(76) Inventors: Ming-Dong Chern, 58, Ma Yuan West St., Taichung (TW); Cheng-Ju Ho, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/144,361

(22) Filed: May 9, 2002

(65) Prior Publication Data

US 2002/0137409 A1 Sep. 26, 2002

Related U.S. Application Data

(63) Continuation-in-part of application No. 09/732,532, filed on Dec. 4, 2000, now abandoned.

(51) Int. Cl.[7] ..... B63C 9/15

(52) U.S. Cl. ..... 441/124; 441/103; 441/107; 441/113

(58) Field of Search ..... 441/88, 102–119, 441/124

(56) References Cited

U.S. PATENT DOCUMENTS

| | | | | | |
|---|---|---|---|---|---|
| 2,629,118 | A | * | 2/1953 | Frieder et al. | 441/110 |
| 4,097,947 | A | * | 7/1978 | Kiefer | 441/116 |
| 5,775,967 | A | * | 7/1998 | Lacoursiere et al. | 441/115 |
| 5,800,227 | A | * | 9/1998 | Brown, Jr. | 441/80 |
| 6,270,386 | B1 | * | 8/2001 | Visocekas | 441/80 |

FOREIGN PATENT DOCUMENTS

| | | | |
|---|---|---|---|
| GB | 2 162 129 A | * | 1/1986 |
| GB | 2 361 216 A | * | 10/2001 |

* cited by examiner

*Primary Examiner*—Sherman Basinger

(57) ABSTRACT

A life jacket has two head air bags, a plurality of shoulder air bags, a zipper disposed between the head air bags, and a plurality of pockets. Each of the pockets receives an inflated bag. A safety pin is disposed on the inflated bag. An air inlet hose is connected to the corresponding shoulder air bag and a pressing ball. Each of the head air bags has a hook-and-loop type fastener.

5 Claims, 15 Drawing Sheets

LIFE JACKET

The present invention is a continuation-in-part of application Ser. No. 09/732,532, filed on Dec. 4, 2000, now abandoned.

BACKGROUND OF THE INVENTION

The present invention relates to a life jacket. More particularly, the present invention relates to a life jacket which has a plurality of air bags.

A conventional safety vest does not have a floating headgear to protect a head of a user. Even if the user wears the conventional safety vest, the head of the user may be underwater while the user cannot swim.

SUMMARY OF THE INVENTION

An object of the present invention is to provide a life jacket which has a plurality of air bags to be converted to a floating headgear in order to protect a head of a user.

Another object of the present invention is to provide a life jacket which has two sleeves in order to protect two arms of a user.

Another object of the present invention is to provide a life jacket which has two gloves in order to protect two hands of a user.

Accordingly, a life jacket comprises two head air bags, a plurality of shoulder air bags, a zipper disposed between the head air bags, and a plurality of pockets. Each of the head air bags has a hook-and-loop type fastener. A headgear is formed by the head air bags.

DETAILED DESCRIPTION OF THE INVENTION

Figure 1:
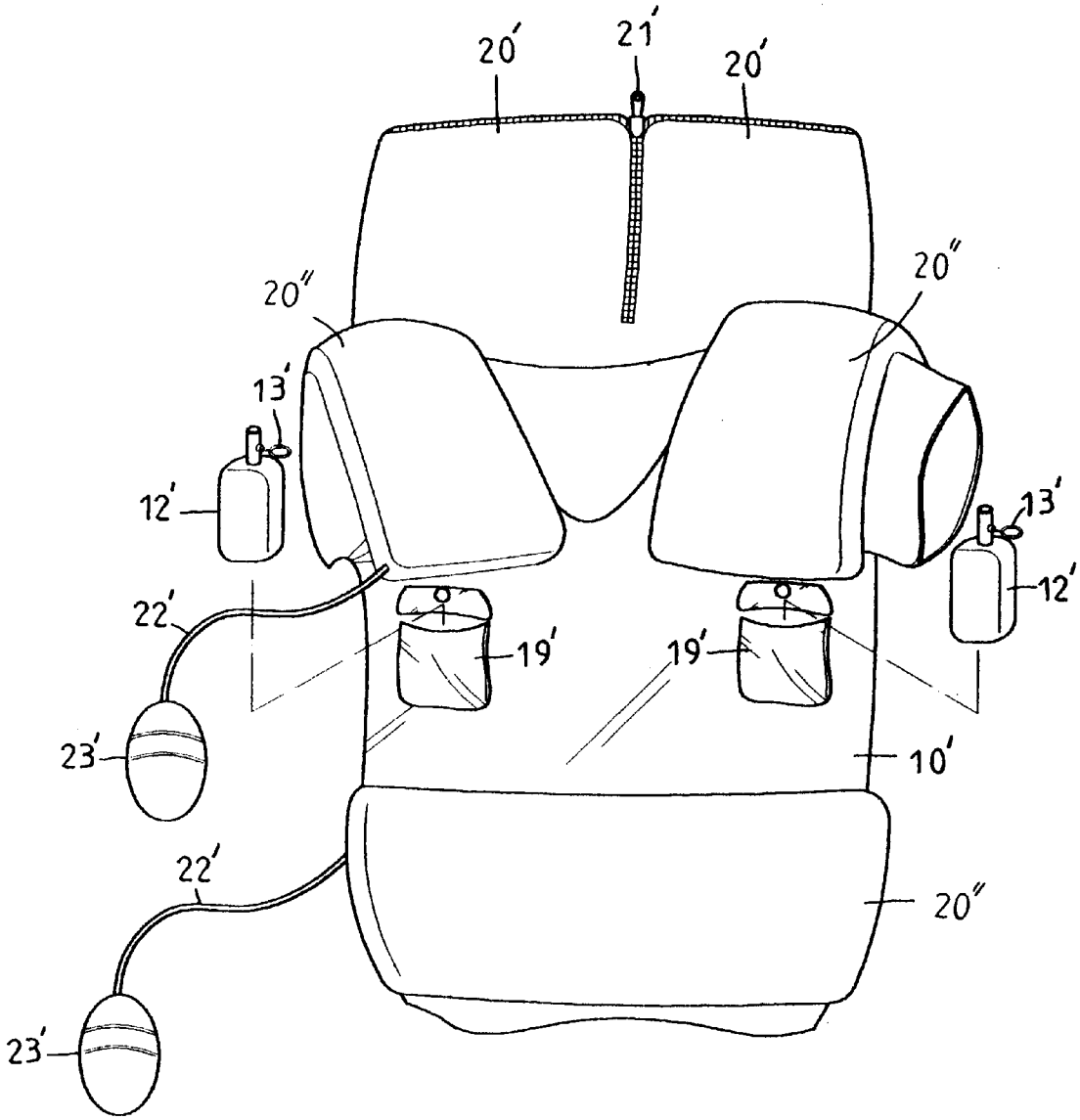
FIG. 1 is a perspective view of a life jacket of a first preferred embodiment in accordance with the present invention.
Figure 1A:
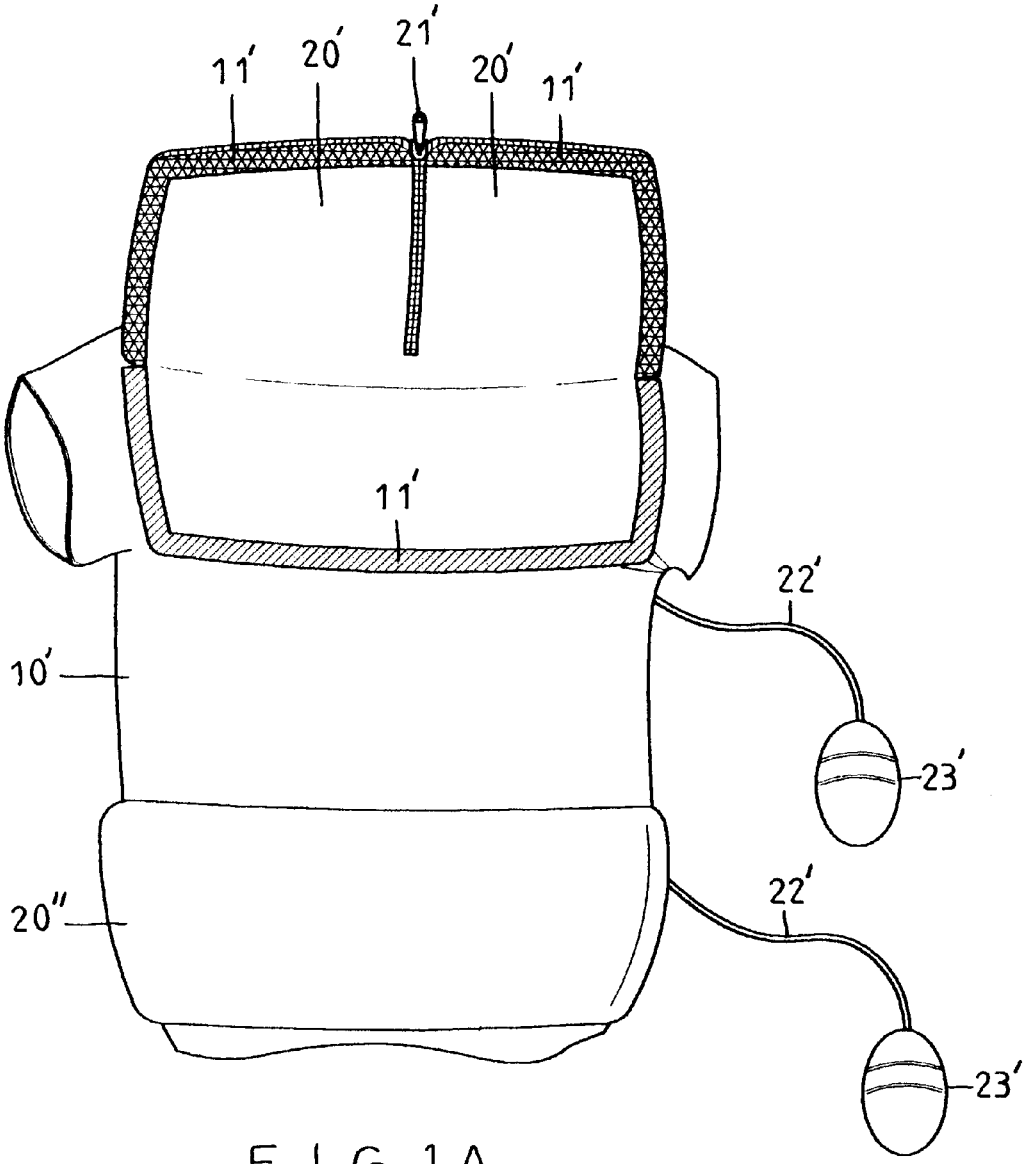
FIG. 1A is another perspective view of a life jacket of a first preferred embodiment in accordance with the present invention.
Figure 1B:
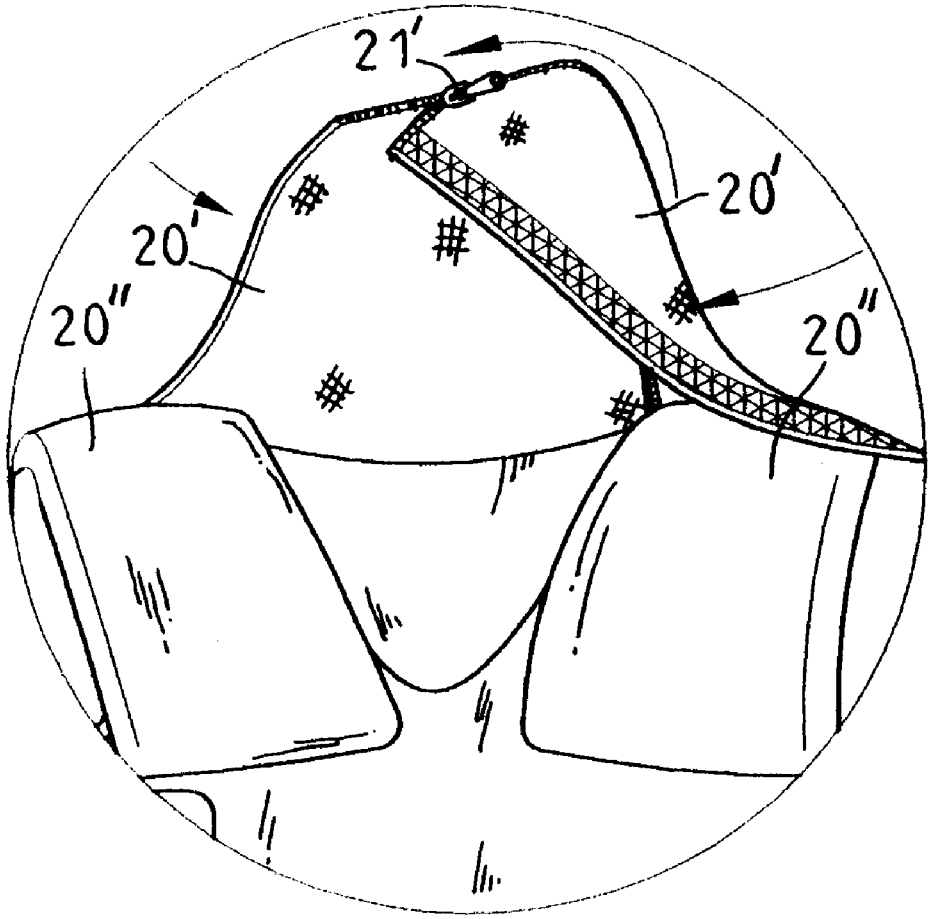
FIG. 1B is a perspective view of a zipper and two air bags of a first preferred embodiment in accordance with the present invention.
Figure 1C:
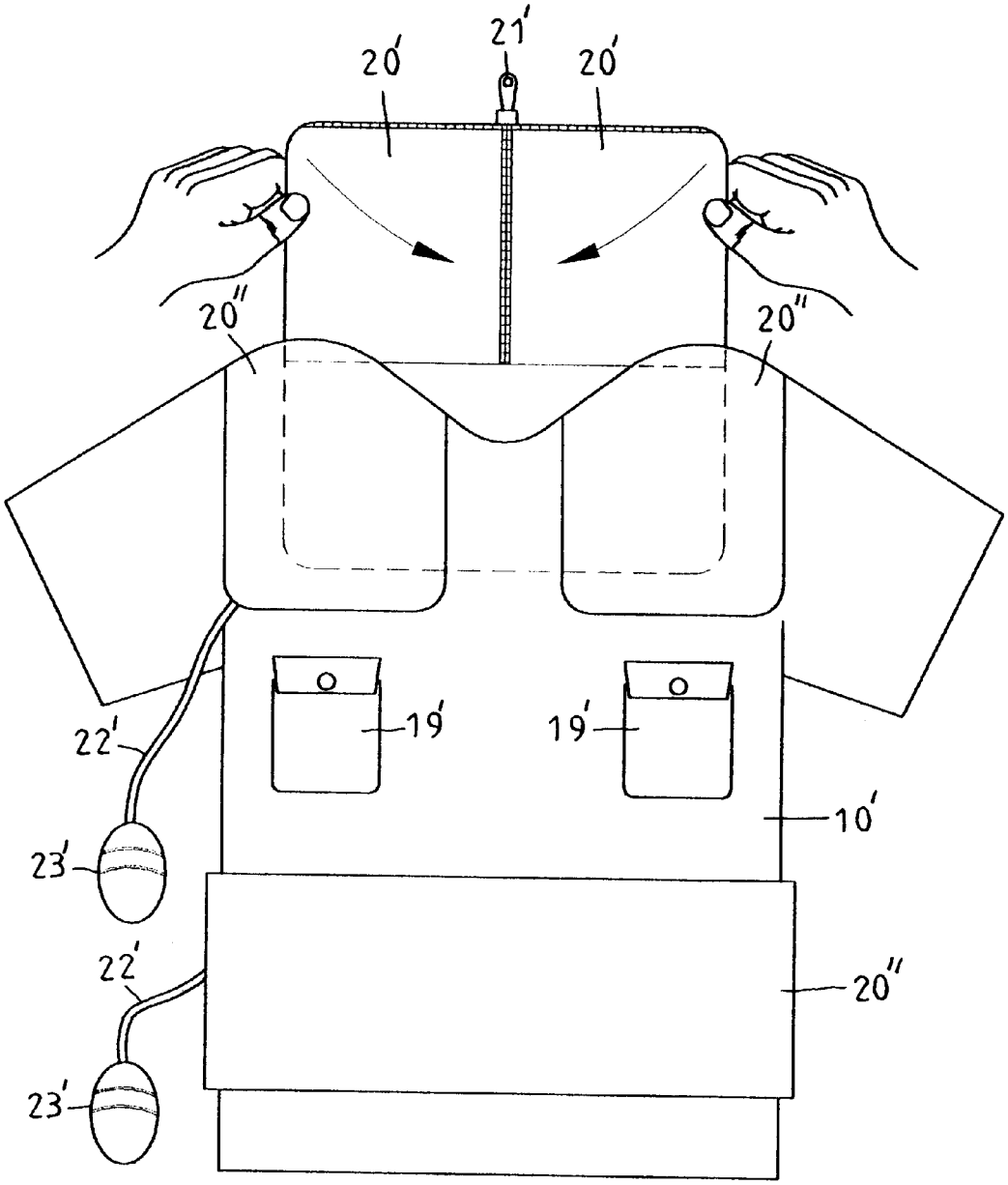
FIG. 1C is a schematic view illustrating a headgear of a life jacket of a first preferred embodiment is not formed.
Figure 1D:
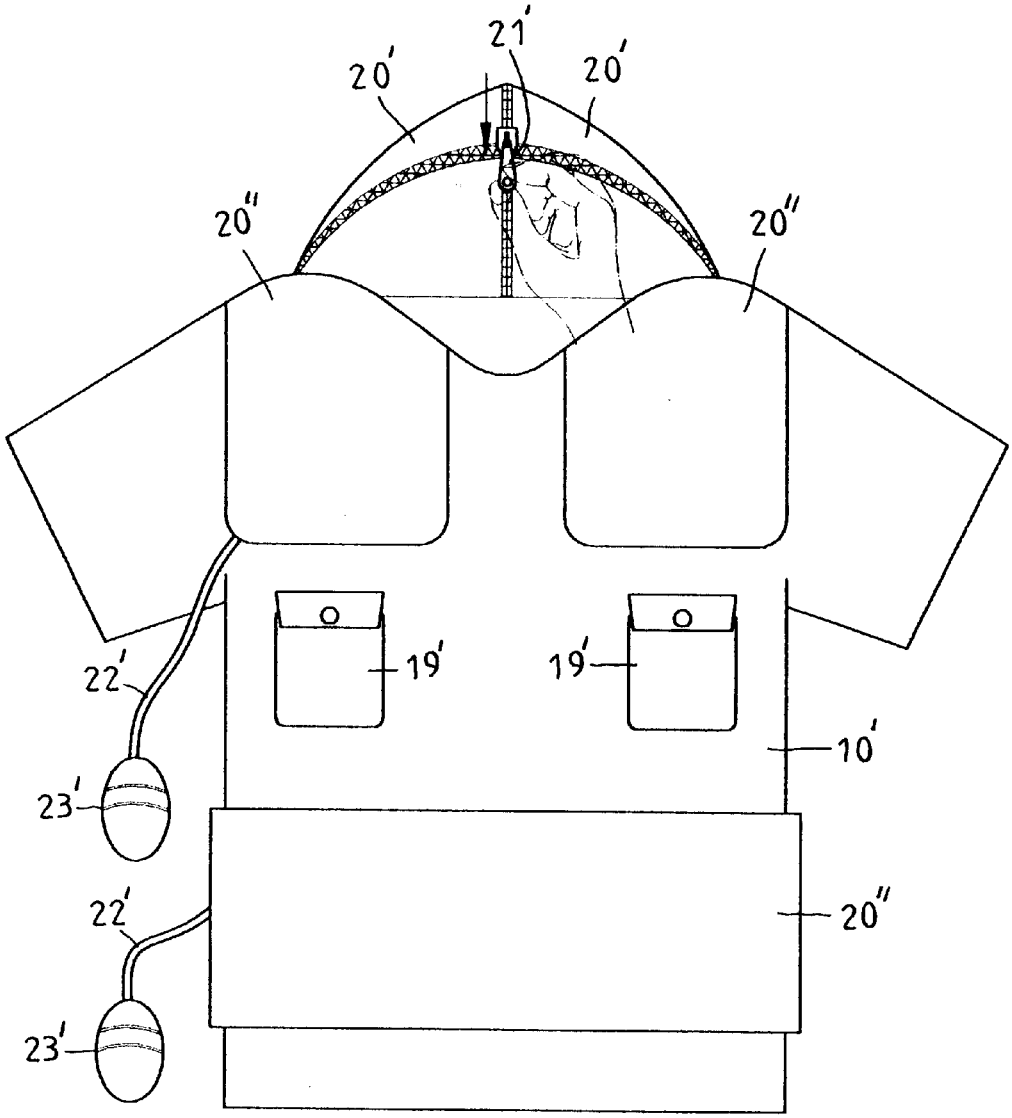
FIG. 1D is a schematic view illustrating a headgear of a life jacket of a first preferred embodiment is formed by two head air bags.
Figure 2:
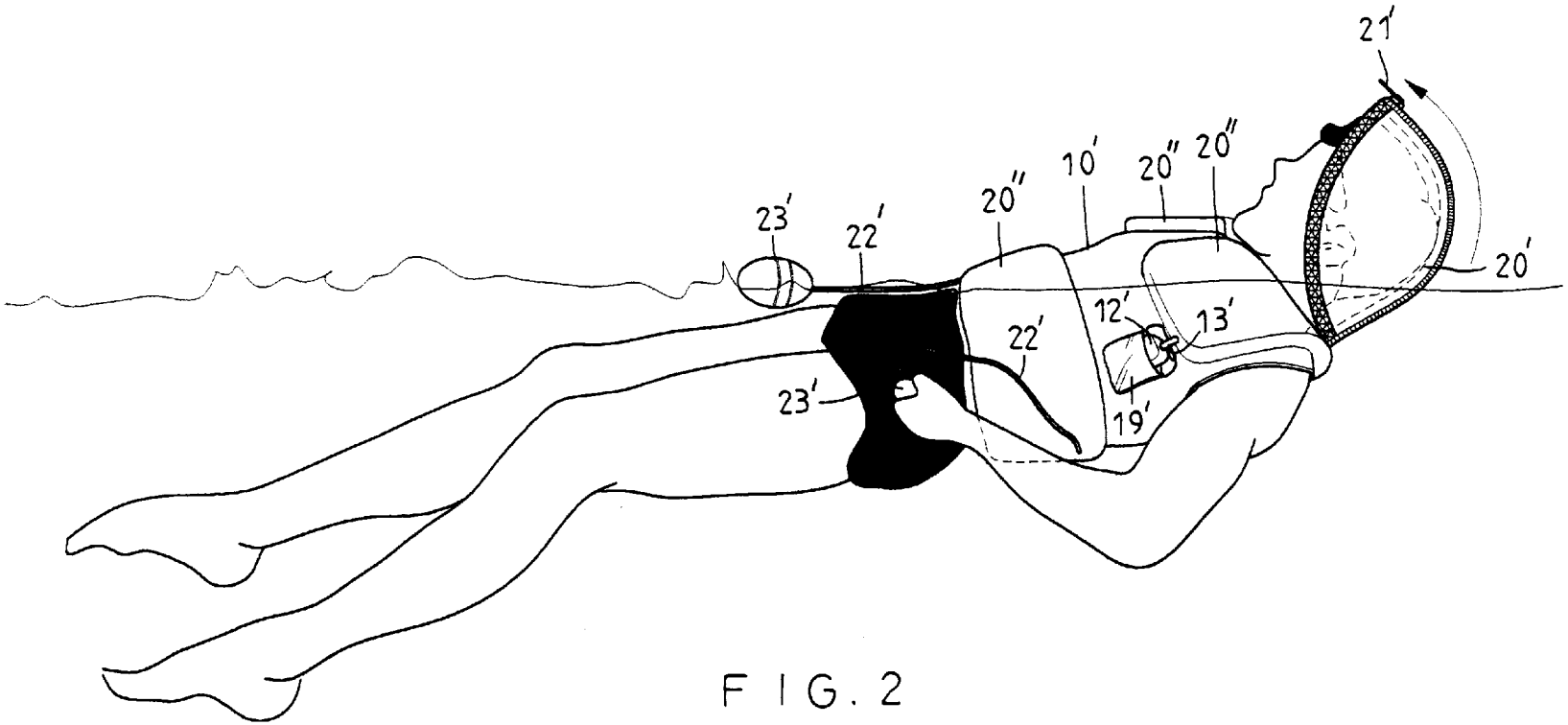
FIG. 2 is a schematic view illustrating an application of a life jacket of a first preferred embodiment in accordance with the present invention.
Figure 2A:
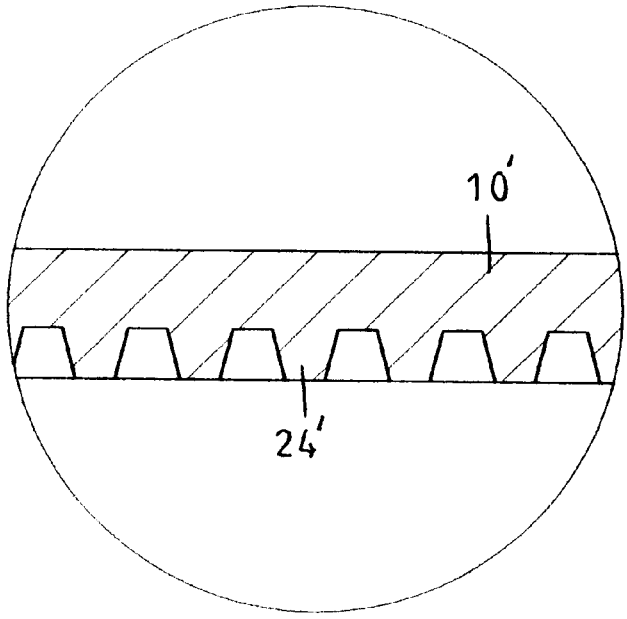
FIG. 2A is a sectional view of a plurality of protrusions of a first preferred embodiment in accordance with the present invention.

Referring to FIGS. 1 to 2A, a first life jacket 10' comprises two head air bags 20', a plurality of shoulder air bags 20", a zipper 21' disposed between the head air bags 20', and a plurality of pockets 19'.

The pockets 19' are adhered on the first life jacket 10' by a high frequency method.

Each of the pockets 19' receives an inflated bag 12'. A safety pin 13' is disposed on the inflated bag 12'. The inflated bag 12' has carbon dioxide therein. An air inlet hose 22' is connected to the corresponding shoulder air bag 20' and a pressing ball 23'.

Each of the head air bags 20' has a hook-and-loop type fastener 11'. The first life jacket 10' has a large number of protrusions 24' therein. A headgear is formed by two of the head air bags 20'.

Figure 3:
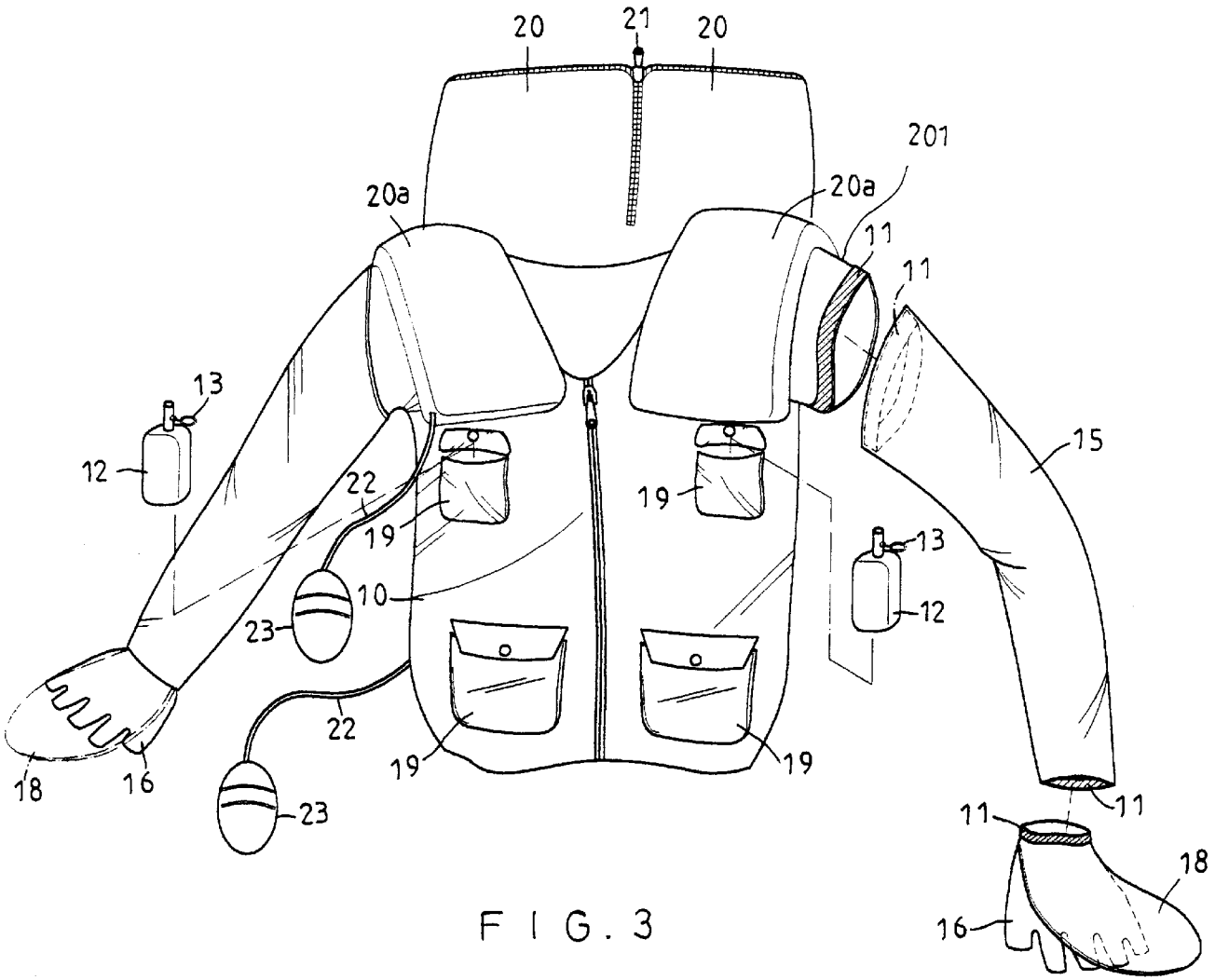
FIG. 3 is a perspective view of a life jacket of a second preferred embodiment in accordance with the present invention.
Figure 3A:
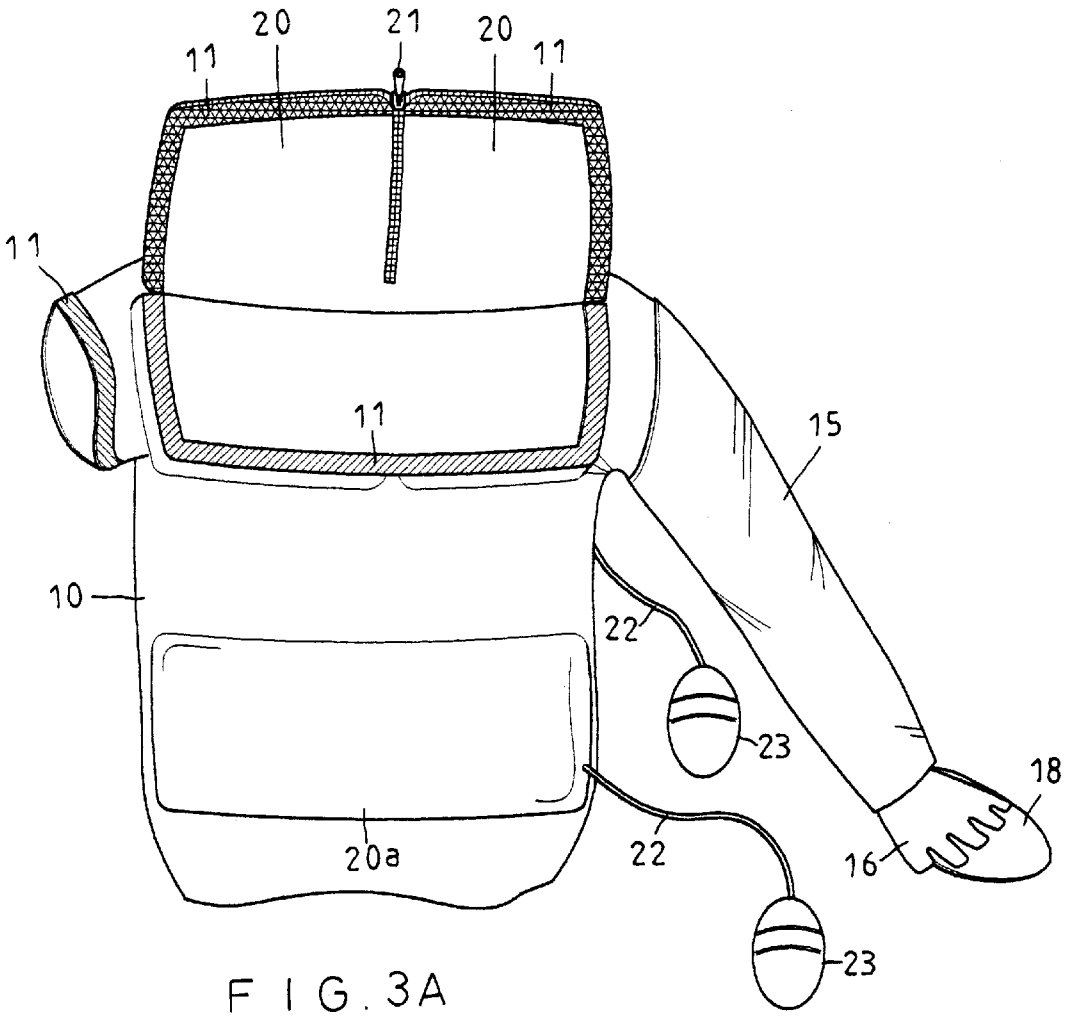
FIG. 3A is another perspective view of a life jacket of a second preferred embodiment in accordance with the present invention.
Figure 3B:
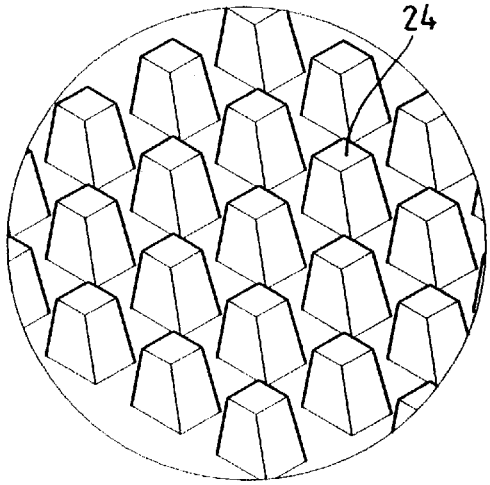
FIG. 3B is a perspective view of a plurality of protrusions of a second preferred embodiment in accordance with the present invention.
Figure 3C:
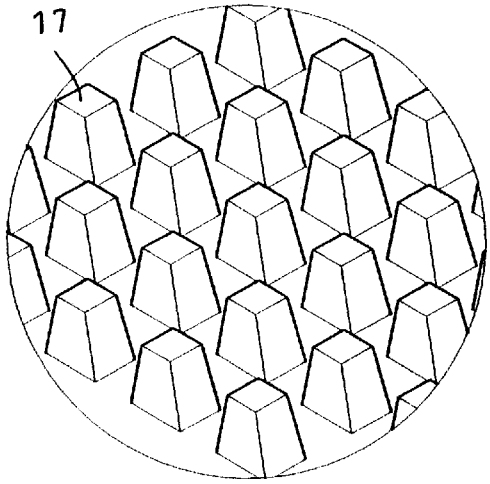
FIG. 3C is a perspective view of a plurality of protruded blocks of a second preferred embodiment in accordance with the present invention.
Figure 4:
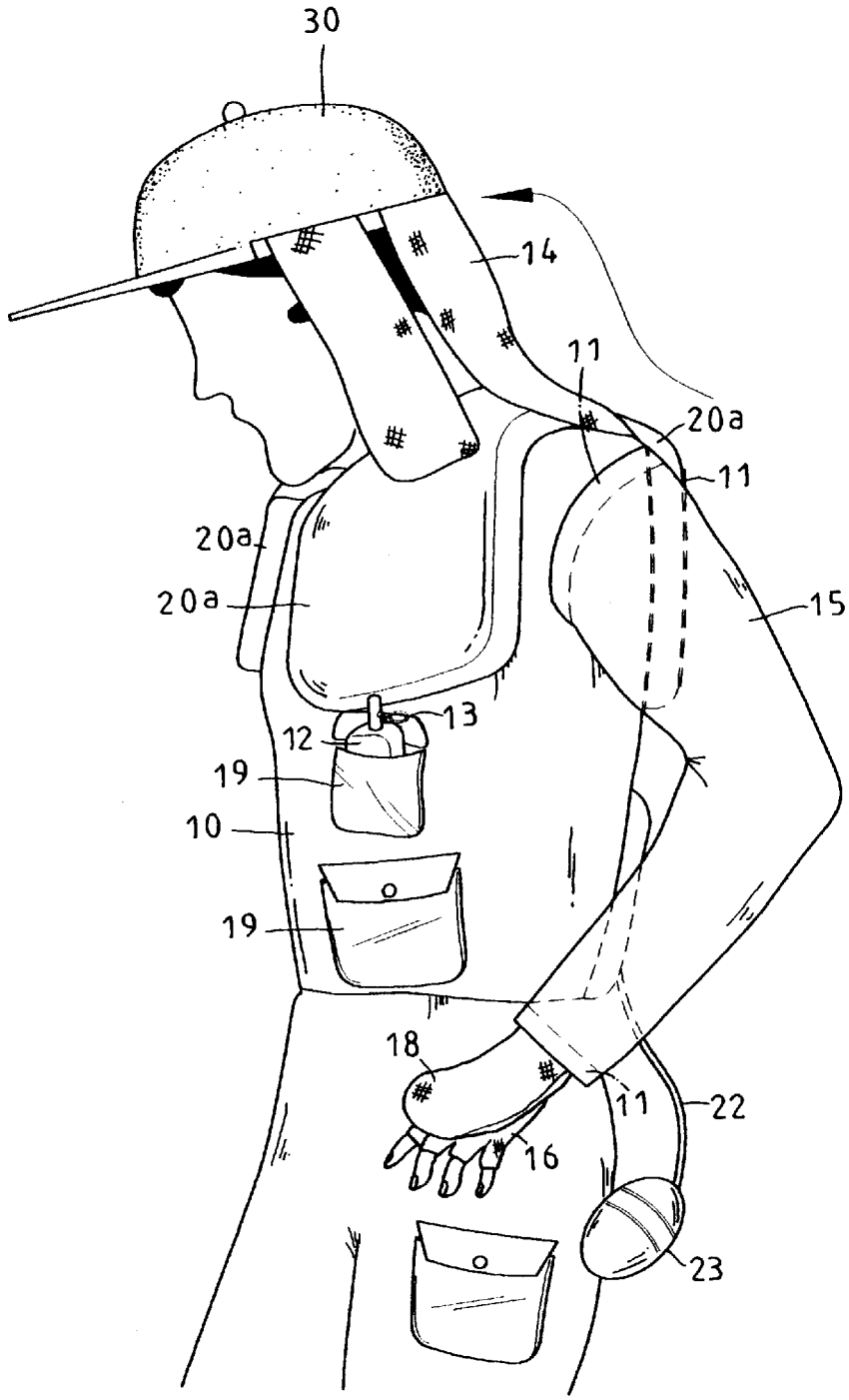
FIG. 4 is a schematic view illustrating an application of a life jacket of a second preferred embodiment in accordance with the present invention.
Figure 4A:
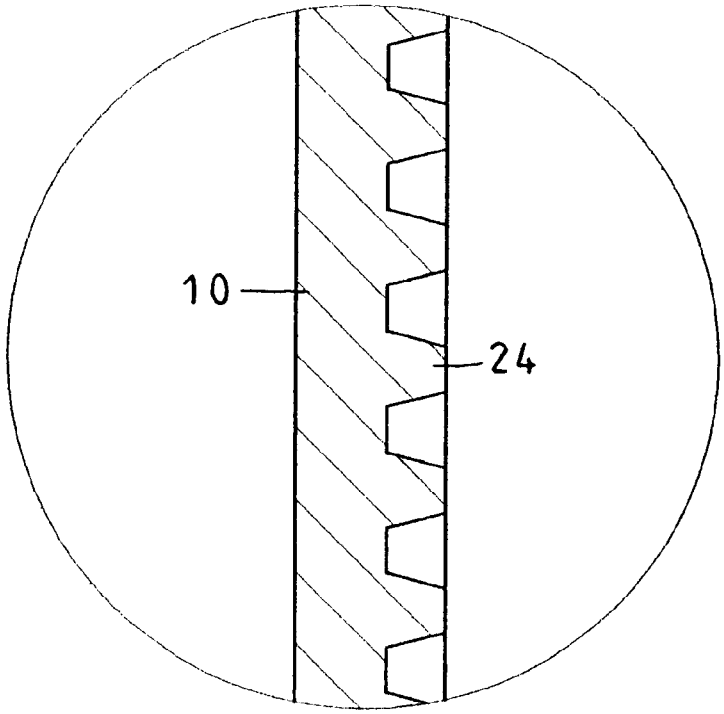
FIG. 4A is a sectional view of a plurality of protrusions of a second preferred embodiment in accordance with the present invention.

Referring to FIGS. 3 to 4A, a second life jacket 10 comprises two head air bags 20, a plurality of shoulder air bags 20*a*, a zipper 21 disposed between the head air bags 20, a plurality of pockets 19, two arms 201, and two sleeves 15.

Each of the pockets 19 receives an inflated bag 12. A safety pin 13 is disposed on the inflated bag 12. The inflated bag 12 has carbon dioxide therein. An air inlet hose 22 is connected to the corresponding shoulder air bag 20 and a pressing ball 23.

The second life jacket 10 has a large number of protrusions 24 therein.

Each of the arms 201 has a hook-and-loop type fastener 11.

Each of the sleeves 15 is connected to the corresponding arm 201. Two gloves 16 are connected to the sleeves 15. Each of the gloves 16 has a fabric 18 and a large number of protruded blocks 17.

The head air bags 20 are made of rubber.

The shoulder air bags 20*a* are made of rubber.

The gloves 16 are made of rubber.

A hood 14 is disposed on the shoulder air bags 20.

A user wears a cap 30. The hood 14 is connected to the cap 30.

Figure 5:
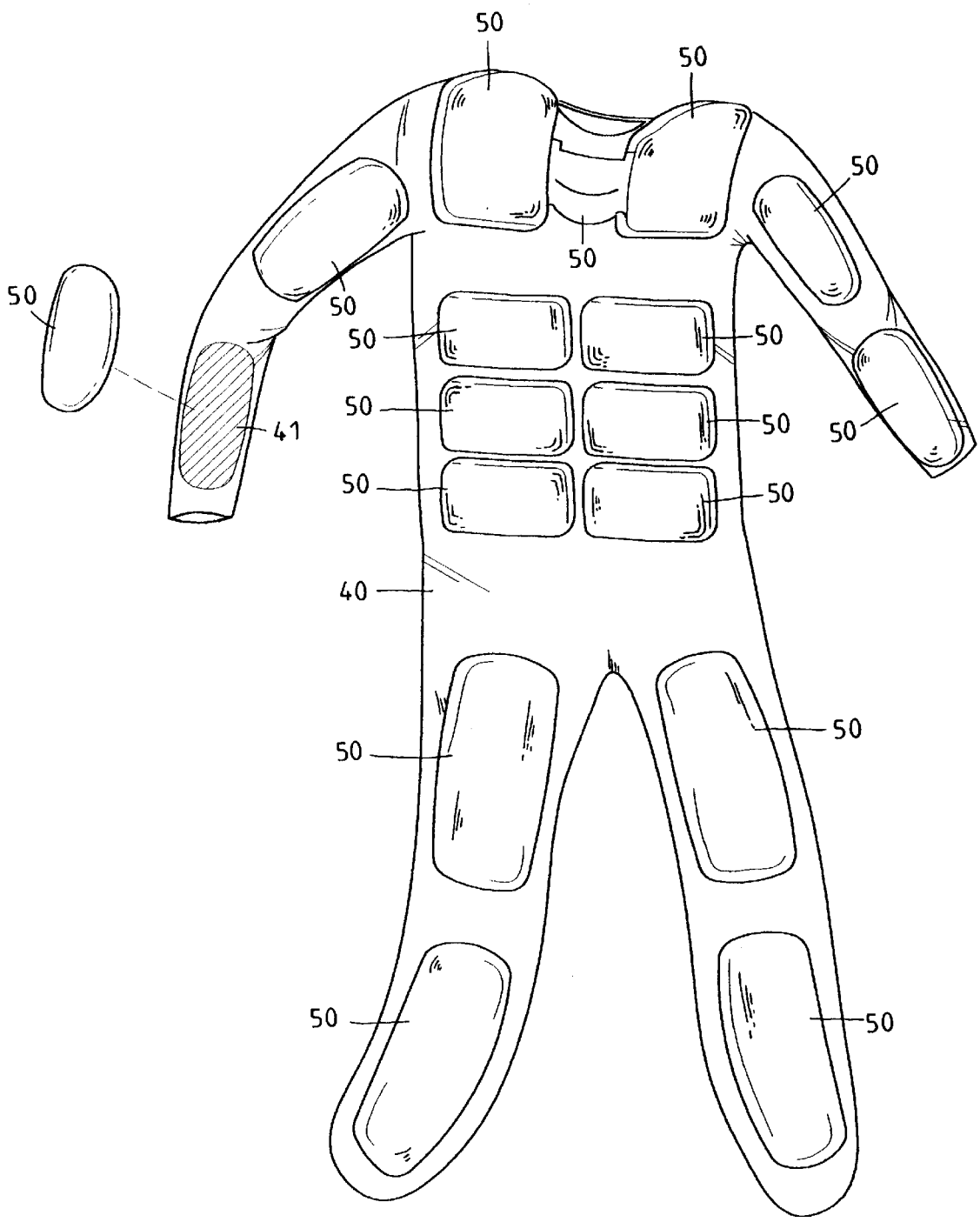
FIG. 5 is a perspective view of a life jacket of a third preferred embodiment in accordance with the present invention.
Figure 5A:
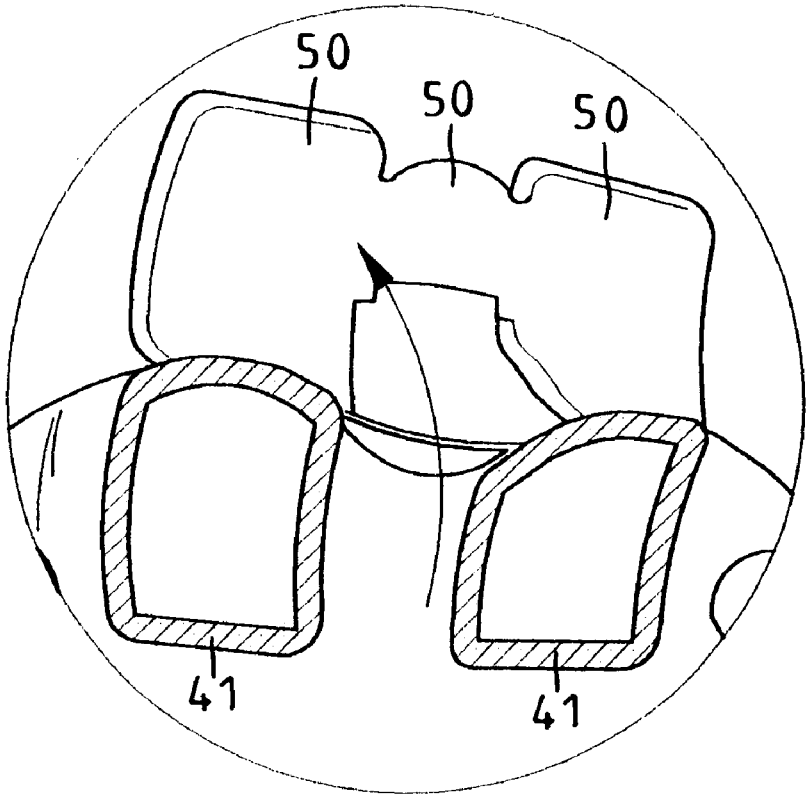
FIG. 5A is a partially perspective view of a life jacket of a third preferred embodiment in accordance with the present invention.
Figure 6:
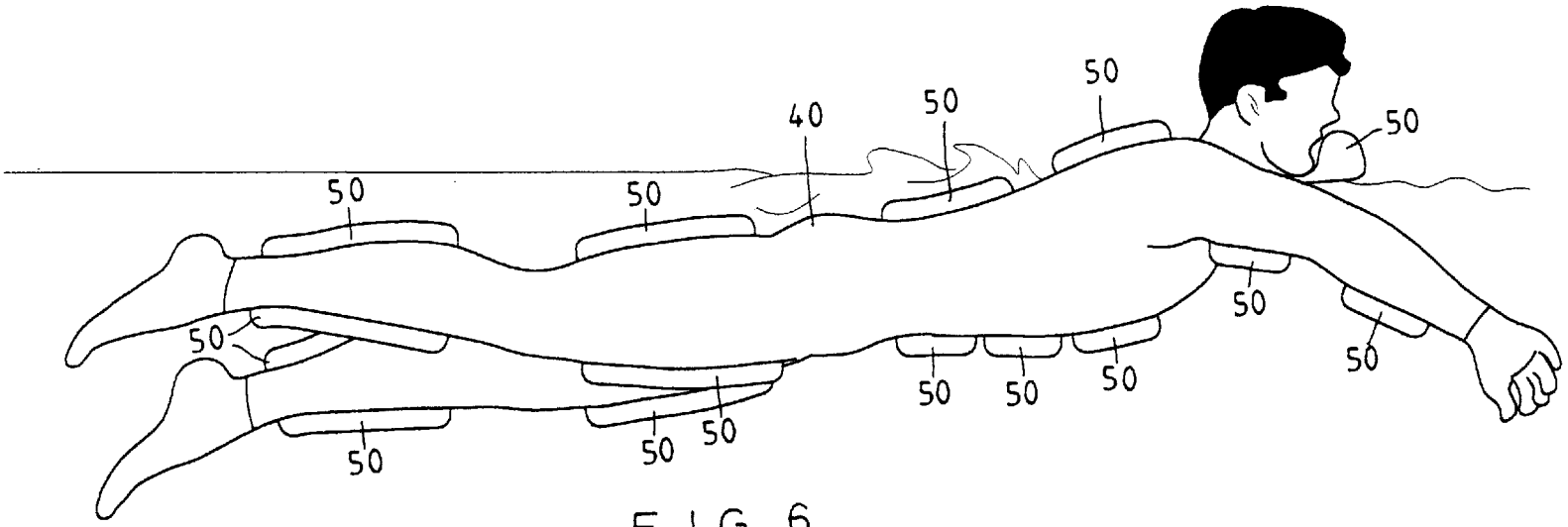
FIG. 6 is a schematic view illustrating an application of a life jacket of a third preferred embodiment in accordance with the present invention.

Referring to FIGS. 5, 5A, and 6, a third life jacket 40 comprises a plurality of hook-and-loop type fasteners 41, and a plurality of air bags 50 disposed on the hook-and-loop type fasteners 41.

The invention is not limited to the above embodiment but various modification thereof may be made without departing from the scope of the invention.

We claim:

1. A life jacket comprises:

two head air bags, a plurality of shoulder air bags, a zipper disposed between the head air bags, and a plurality of pockets, each of the head air bags having a hook-and-loop type fastener, and a headgear formed by the head air bags.

2. The life jacket as claimed in claim 1, wherein an air inlet hose is connected to the corresponding shoulder air bag and a pressing ball.

3. The life jacket as claimed in claim 1, wherein an inflated bag is disposed in the corresponding pocket, a safety pin is disposed on the inflated bag, and the inflated bag has carbon dioxide therein.

4. The life jacket as claimed in claim 1, wherein two arms are disposed on the life jacket, each of the arms has a hook-and-loop type fastener, and a sleeve is connected to a corresponding arm.

5. The life jacket as claimed in claim 4, wherein two gloves are connected to the sleeves, and each of the gloves has a fabric and a large number of protruded blocks.

* * * * *